United States Patent [19]

Swift et al.

[11] Patent Number: 4,953,366

[45] Date of Patent: Sep. 4, 1990

[54] ACOUSTIC CRYOCOOLER

[75] Inventors: Gregory W. Swift, Santa Fe; Richard A. Martin, Los Alamos, both of N. Mex.; Ray Radebaugh, Louisville, Colo.

[73] Assignee: The United States of America as represented by the United States Department of Energy, Washington, D.C.

[21] Appl. No.: 412,712

[22] Filed: Sep. 26, 1989

[51] Int. Cl.[5] ..... F25B 1/00

[52] U.S. Cl. ..... 62/467; 60/721

[58] Field of Search ..... 62/5, 6, 467; 60/721

[56] References Cited

U.S. PATENT DOCUMENTS

| | | | |
|---|---|---|---|
| 3,237,421 | 3/1966 | Gifford | 62/88 |
| 4,114,380 | 9/1978 | Ceperley | 60/721 |
| 4,355,517 | 10/1982 | Ceperley | 62/467 |
| 4,398,398 | 8/1983 | Wheatley et al. | 62/467 |
| 4,489,553 | 12/1984 | Wheatley et al. | 60/516 |
| 4,722,201 | 2/1988 | Hofler et al. | 62/467 |

OTHER PUBLICATIONS

John Wheatley et al., "Understanding Some Simple Phenomena in Thermoacoustics with Applications to Acoustical Heat Engines," 53 Am J. Phys. No. 2, pp. 147–162 (Feb. 1985).

E. I. Mikulin et al., "Low-Temperature Expansion Pulse Tubes," 29 Adv. Cryo. Eng., pp. 629–639 (5/1985).

John C. Wheatley et al., "The Natural Heat Engine," 14 Los Alamos Science No. 14, pp. 1–33 (8/1986).

Ray Radebaugh, "Pulse Tube Refrigeration–A New Type of Cryocooler," 26 Jpn. J. Appl. Phys., Suppl. 26–3, pp. 2076 (9/1987).

G. W. Swift, "Thermoacoustic Engines," 84 J. Acoust. Soc. Am. No. 4, pp. 1145–1180 (Oct. 1988).

*Primary Examiner*—Ronald C. Capossela

*Attorney, Agent, or Firm*—Ray G. Wilson; Paul D. Gaetjens; William R. Moser

[57] ABSTRACT

An acoustic cryocooler with no moving parts is formed from a thermoacoustic driver (TAD) driving a pulse tube refrigerator (PTR) through a standing wave tube. Thermoacoustic elements in the TAD are spaced apart a distance effective to accommodate the increased thermal penetration length arising from the relatively low TAD operating frequency in the range of 15–60 Hz. At these low operating frequencies, a long tube is required to support the standing wave. The tube may be coiled to reduce the overall length of the cryocooler. One or two PTR's are located on the standing wave tube adjacent antinodes in the standing wave to be driven by the standing wave pressure oscillations. It is predicted that a heat input of 1000 W at 1000 K will maintian a cooling load of 5 W at 80 K.

18 Claims, 3 Drawing Sheets

ACOUSTIC CRYOCOOLER

This invention is the result of a contract with the Department of Energy (Contract No. W-7405-ENG-36).

BACKGROUND OF THE INVENTION

This invention relates to low temperature cooling and, more particular, to pulse-tube cooling.

There are an increasing number of applications that require cooling to cryogenic temperatures, i.e., 110K. and lower. For example, high temperature superconductivity occurs at temperatures which are supported by liquid nitrogen, having a boiling point of 77K. A class of refrigerators known as regenerative cryocoolers provides a relatively simple refrigeration system for operating at these temperatures. Probably the best known example of a regenerative cryocooler is a Stirling refrigerator. A fluid operating medium is compressed, displaced, expanded, and returned by oscillatory devices at end volumes of the refrigerator adjacent a region of high heat capacity, the regenerator, wherein the compression, displacement, expansion, and return are in a phased relationship to transport heat from one end of the regenerator to the other. The regenerator includes a plurality of surfaces axially aligned between the end regions and having a spacing between surfaces which is much smaller than a thermal penetration depth (i.e., basically, the distance that heat diffuses during a cycle of the driving wave) to maintain the fluid temperature at the same temperature as the surface.

In an adaptation of the Stirling refrigerator, one of the oscillatory devices at one end of the engine is replaced with a "pulse" tube having a diameter which is a few thermal penetration depths. The pulse tube walls function to enable heat pumping to occur. The heat load, i.e., the "cold" heat exchanger, is located at the boundary between the regenerator and the pulse tube. "Hot" heat exchangers are located at the outer ends of the regenerator and the pulse tube to remove the transferred heat. A pulse tube refrigerator (PTR) is described in U.S. Pat. No. 3,237,421, issued Mar. 1966 to W. E. Gifford, incorporated herein by reference.

A refinement of the pulse tube refrigerator incorporates a large volume connected to the pulse tube by a flow impedance, e.g., an adjustable needle valve, for increasing the average fluid velocity throughout the engine, whereby the pulse tube pumps more heat to increase the total cooling power. An orifice pulse-tube refrigerator (OPTR) is described in R. Radebaugh, "Pulse Tube Refrigeration-A New Type of Cryocooler," 26 Jpn. J. Appl. Phys., Suppl. 26-3, page 2076 (1987), incorporated herein by reference. The OPTR described by Radebaugh still requires a mechanical compressor with its attendant sealing and mechanical problems and operates at a low frequency, around 10 Hz, and a high-amplitude pressure oscillation, on the order of 2-3 atm. However, operation of an OPTR has been reported to keep temperatures in the 60K. range.

It would clearly be preferable to provide an OPTR without having to rely on compressors or other devices with moving parts to generate the oscillatory pressure which drives the device. There is a class of engines which converts heat energy into acoustic energy with no moving parts. These thermoacoustic engines are described in U.S. Pat. Nos. 4,398,398, issued Aug. 16, 1983, to Wheatley et al., 4,489,553, issued Dec. 25, 1984, to Wheatley et al., and 4,722,201, issued Feb. 2, 1988, to Hofler et al. A review of these engines is further presented in an article by J. C. Wheatley et al., "The Natural Heat Engine," 14 Los Alamos Science No. 14, pp. 1-33, (1986) and in G. W. Swift, "Thermoacoustic Engines," 84 J. Acoust. Soc. Am. No. 4, pp. 1145-1180 (Oct. 1988). All of these references are incorporated herein by reference. The article by Wheatley et al., describes a "beer cooler" having both a thermoacoustic prime mover and a refrigerator. The acoustic output of the prime mover generates an acoustic standing wave effective for the refrigerator to generate some cooling. While it would appear desirable to incorporate a thermoacoustic prime mover for activating a pulse tube refrigerator, until the present invention the operating characteristics of a thermoacoustic prime mover were taught to be substantially different from those required by a pulse tube refrigerator: a thermoacoustic driver (TAD) operates at a high frequency, i.e., 500-600 Hz, and with low-amplitude pressure oscillations, i.e., 0.1-0.2 atm. versus an operating frequency of about 10 Hz and pressure amplitude on the order of 2 atm. for an OPTR.

These problems are overcome in the present invention in which a TAD and an OPTR are combined to form a cryocooler having no moving parts.

Accordingly, it is an object of the present invention to provide a pulse tube cryocooler with no moving parts.

Another object of the present invention is to provide a pulse tube cryocooler with operating characteristics which are compatible with a thermoacoustic prime mover.

One other object of the present invention is to provide a thermoacoustic prime mover which generates an acoustic wave at a frequency and pressure amplitude effective for generating low output temperatures in a pulse tube refrigerator.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objects, and in accordance with the purposes of the present invention, as embodied and broadly described herein, the apparatus of this invention may comprise a thermoacoustically driven cryocooler having no moving parts. A pulse tube refrigerator includes a pulse tube, a first heat exchanger adjacent the pulse tube for inputting heat from a thermal load for cooling, and a second heat exchanger for removing heat transferred from the first heat exchanger across the pulse tube. The pulse tube is responsive to a fluid driving frequency for removing heat from the first heat exchanger to the higher temperature at the second heat exchanger. A thermoacoustic prime mover generates a standing acoustic wave to drive the pulse tube refrigerator at the fluid driving frequency and at a pressure amplitude effective to drive the pulse tube for obtaining a selected temperature at the first heat exchanger. A standing wave tube supports the standing wave to define an antinode adjacent the pulse tube refrigerator.

In another characterization of the present invention a thermoacoustic cryocooler having no moving parts includes two thermoacoustic prime movers for generating the standing acoustic wave. At least one pulse tube refrigerator includes a pulse tube, a first heat exchanger adjacent the pulse tube for inputting heat from a thermal load for cooling, and a second heat exchanger for removing heat transferred from the first heat exchanger across the pulse tube. The pulse tube is responsive to the fluid driving frequency for moving heat from the first heat exchanger to a higher temperature at the second heat exchanger. The two thermoacoustic prime movers are spaced apart about ½ wavelength adjacent antinodes of the standing wave and provide a pressure amplitude in the standing wave which is effective to drive the pulse tube for obtaining a selected temperature at the first heat exchanger. The pulse tube refrigerator is located adjacent one of the prime movers and adjacent an antinode of the standing wave.

BRIEF DESCRIPTION OF THE DRAWINGS

The accompanying drawings, which are incorporated in and form a part of the specification, illustrate the embodiments of the present invention and, together with the description, serve to explain the principles of the invention. In the drawings.

DETAILED DESCRIPTION OF THE INVENTION

Figure 1:
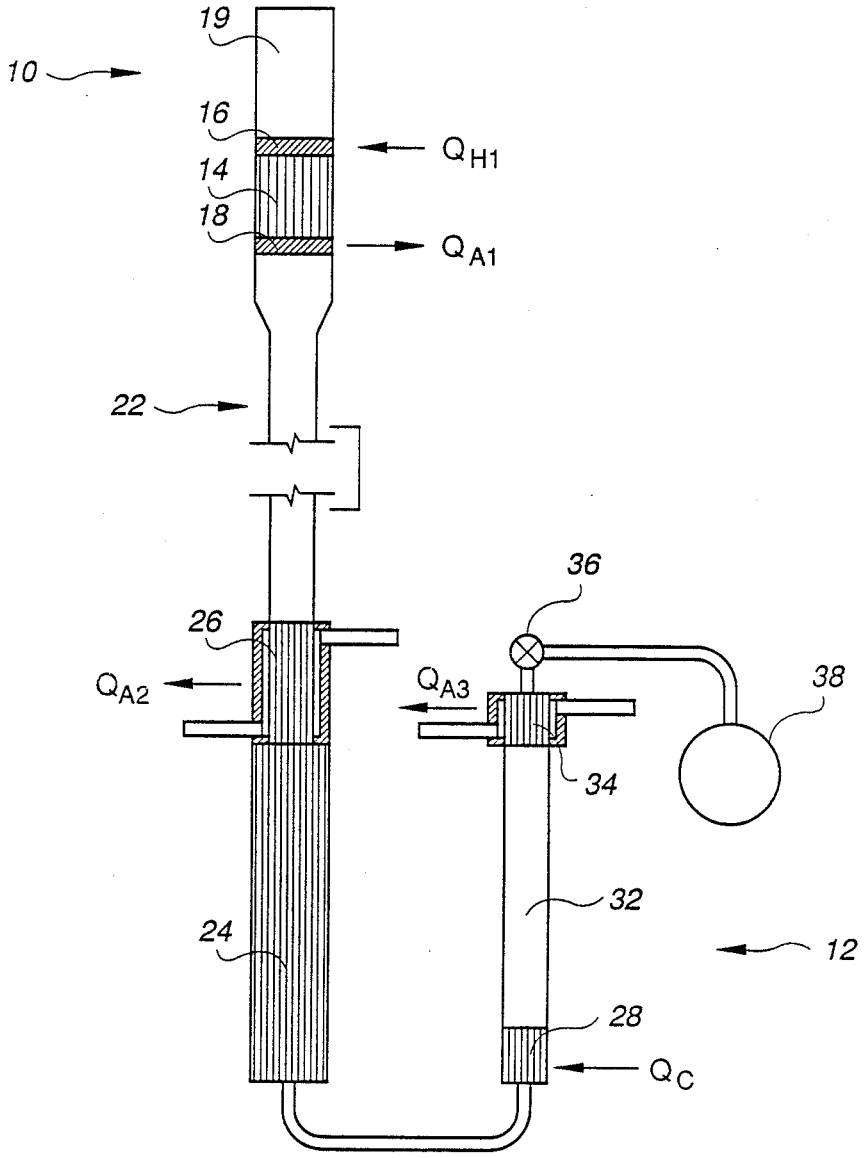
FIG. 1 is a pictorial illustration, in partial cutaway, of a cryocooler according to the present invention.

Referring now to FIG. 1, there is illustrated, in partial cutaway, an acoustic cryocooler according to the present invention. Thermoacoustic prime mover 10 (TAD) is coupled with pulse tube refrigerator 12 (PTR) through standing wave tube 22. The length of standing wave tube 22, including TAD 10, is about ½ the wavelength of the operating frequency for which TAD 10 and PTR 12 are designed.

In a conventional PTR a low operating frequency, i.e., about 10 Hz, is indicated by the need to provide good heat transfer between the operating fluid and the regenerator surfaces. The frequency is small compared to the inverse of the thermal relaxation time in the lateral direction, and the material forming the regenerator material generates substantially no heat flux in the regenerator. The thermal relaxation time is $\tau = d^2/\pi^2\kappa$ (d is surface spacing and $\kappa$ is the fluid thermal diffusivity) and is independent of the operating frequency. The low operating frequency allows convenient flow passage dimensions to be used, e.g., 0.005 cm, while maintaining acceptably low thermal losses in the regenerator.

In accordance with the present invention, however, a relatively high operating frequency is required, e.g., around 15–60 Hz, and preferably 20–30 Hz, for compatibility with TAD 10. The design of regenerator 24 generally establishes the maximum allowable operating frequency to maintain an acceptable thermal contact between the operating fluid and regenerator 24 surfaces. At higher frequencies, smaller fluid channels in regenerator 24 are required to maintain the lateral thermal contact. Smaller channels increase the viscous losses within regenerator 24. To maintain these losses within acceptable limits, the length of regenerator 24 is selected to reduce the drag which has been increased by the smaller channels.

The reduced channels do provide more surfaces in regenerator 24, with a concomitant increase in surface area, while the shorter length of regenerator 24 reduces the surface area adjacent each plate. Thus, the design of regenerator 24 must balance these considerations. Further, the material forming the channels in regenerator 24 must have a high heat capacity relative to the working fluid, while having a low axial thermal conductivity to minimize axial heat flux, e.g., a material such as Kapton.

As shown in FIG. 1, TAD 10 is spaced about ½ wavelength from PTR 12 by standing wave tube 22. Thus, both TAD 10 and PTR 12 are adjacent antinodes of the standing wave. However, the output power of TAD 10 is related to the fluid velocity across thermodynamic elements, or stack 14, generating the standing wave, and stack 14 is displaced by volume 19 from the precise location of the standing wave antinode. The cooling power of OPTR 12 is related to the pressure amplitude and OPTR 12 is preferably located close to the antinode.

It will be appreciated that, for a sinusoidal-type wave, there is a relatively large axial distance over which the standing wave amplitude does not vary appreciably from the maximum value at the antinode. For example, over a distance of ±10% of the half wavelength, the standing wave amplitude decreases only about 5% from the peak amplitude. For a typical working fluid, such as He, at an operating frequency of 20–30 Hz, the wavelength is about 50–30 m, respectively, so that the region adjacent the antinode, i.e., where the amplitude is within 5% of the peak, is a distance of several meters. As hereinafter shown, the dimensions of TAD 10 and PTR 12 are well below these dimensions and the placement of PTR 12 at the antinode is not critical. As used herein, the term "adjacent an antinode" means a region near the antinode where TAD 10 and OPTR 12 obtain their design operating performance, typically within 10% of the half wavelength.

As noted above, the conventional operating frequency for a TAD is several hundred Hz, typically 400–500 Hz, a frequency substantially greater than an operating frequency for PTR 12, about 20–30 Hz in this case. In accordance with the present invention, it has been determined that TAD stack 14 can be configured to operate at this relatively low frequency. The distance between plates in stack 14 is determined by the thermal penetration length, $\delta_K$, where the operating fluid temperature is substantially the temperature of the adjacent plate surface. This thermal penetration length is defined as $$\delta_K = (K/\pi f \rho_m c_p)^{\frac{1}{2}}. \quad (1)$$

where K is the fluid thermal conductivity, $\rho_m$ the fluid density, $c_p$ the fluid heat capacity per unit mass, and f the operating frequency.

In accordance with Equation 1, $\delta_K$ increases as the frequency decreases so that the plate spacing in stack 14 is considerably increased over the plate spacing in a conventional TAD stack. Suprisingly, it has been determined that these large plate spacings will still provide a thermoacoustic engine.

As further shown in FIG. 1, a plurality of heat exchangers are provided to support the required heat flows. The desired refrigeration at low temperature is obtained at heat exchanger (Hx) 28 where the cooling load $Q_c$ occurs. Heat is removed from PTR 12 at ambient temperature by Hx 26 and Hx 34. When pulse tube 32 is a closed end volume the walls of pulse tube 32 provide a heat pumping surface to transfer a portion of the heat load $Q_c$ to Hx 34.

Hx 16 and Hx 18 associated with TAD 10 perform a substantially different function. Heat input $Q_{H1}$ to Hx 16 at a relatively high temperature and heat removal $Q_{A1}$ through Hx 18 at ambient temperature establish a temperature difference across stack 14 in TAD 10. The temperature difference provides the necessary energy to generate the fluid changes producing an acoustic wave within standing wave tube 22. Thus, some of the thermal energy flowing from Hx 16 to Hx 18 is converted by stack 14 to acoustic energy at a resonant frequency determined by standing wave tube 22 for driving PTR 12 which is located about ½ wavelength from TAD 10.

Standing wave tube 22 may have a reduced diameter for decreased energy losses along the tube length. As fully discussed in U.S. Pat. No. 4,722,201, referenced above, there is a particular diameter of tube 22 that will minimize the viscous and acoustic losses in tube 22. The viscous losses increase as the square of the fluid velocity and are also proportional to the circumference and length of tube 22. However, the tube length and circumference, and associated acoustic losses, decrease rapidly as the diameter of tube 22 decreases. Thus, although the fluid velocity is increasing as the diameter decreases, there is an optimum reduced diameter to minimize these losses.

PTR 12 is connected to tube 22 adjacent an antinode of the standing wave generated by TAD 10. Heat $Q_{A2}$ is removed from the working fluid in heat exchanger 26 before the fluid enters regenerator 24. Heat exchanger 26 may be comprised of a stack of about 100 copper screens of 80 mesh and 5 cm diameter. The heat is removed by water flowing through an outer jacket. Alternatively, parallel, spaced apart copper plates may be used for heat exchanger 26. Regenerator 24 may be comprised of a stainless steel tube, 5 cm diameter by 20 cm long, filed with 200 mesh stainless steel screen. Alternatively the regenerator 24 may be filled with a Kapton sheet rolled into a cylinder with suitable spacers between the layers to provide a sufficiently low pressure drop at the operating frequency of TAD 10. Heat $Q_C$ is absorbed at a low temperature by heat exchanger 28. Pulse tube 32 may be a stainless steel tube 2 cm diameter by 20 cm long. Heat is rejected to water in heat exchanger 34, which may be formed of a stack of 100 cooper screens of 80 mesh and 2 cm diameter. Alternatively, parallel, spaced apart copper plates may also be used for heat exchanger 34.

As further shown in FIG. 1, PTR 12 may include orifice 36 and reservoir volume 38. The addition of reservoir 38 and orifice 36 enables pressure oscillations in the pulse tube to cause oscillatory flow in the orifice, in phase with the pressure oscillations. This oscillatory flow enables the pulse tube 32 to pump more heat, increasing the total cooling power of PTR 12.

An exemplary design of the acoustic cryocooler shown in FIG. 1 is set out in Table I. The calculated performance estimates of the acoustic cryocooler design, using a working fluid of He gas at 30 atm. as illustrated in Table I, indicate that a temperature of about 70K may be produced at Hx 28 with no load condition, and a temperature of 80K with a 5W load.

TABLE I

| TAD 10 | PTR 12 |
|---|---|
| Tube 22 | Regenerator 24 |
| 25 m × 2 cm* | 10 cm × 5 cm* |
| | 200 mesh s.s. screens |
| Elements of Stack 14 | Hx 26 |
| 0.1 mm s.s. sheets | 5 cm dia. |
| 1 m length | 100 80-mesh Cu screens |
| 1 mm spacing | |
| axially aligned | |
| Hx 16, 18 | Hx 28 |
| 10 cm × 2 cm* | 2 cm dia |
| 0.1 mm Cu plates | 100 100-mesh Cu screens |
| 1 mm spacing | Hx 34 |
| axially aligned | 2 cm dia. |
| perpendicular to | 100 80-mesh Cu screens |
| elements 14 | pulse tube 32 |
| | 20 cm × 2 cm* |
| Hx 16 is spaced about | orifice 36 |
| 40 cm from end of | needle valve |
| tube 22 | 3 mm orfice |
| | reservoir 38 |
| | 3 liters |

*Dimensions are length × diameter

Heat input $Q_{H1}$ at Hx 16 is 1000W at 1000K. Hx 18, 26, and 34 are all maintained at room temperature. Hx 18 removes 750W of heat, leaving 250W for acoustic power into standing wave tube 22. The long length of tube 22 dissipates 185W, leaving 65W available for delivery to PTR 12. The oscillating pressure amplitude at PTR 12 is about 4 atm. Hx 26 removes heat $Q_{A2}$ on the order of 50W and Hx 34 removes heat $Q_{A3}$ on the order of 10W for a 5W load $Q_c$ at Hx 28.

It should be noted that colder temperatures may be obtained by using multiple pulse tubes in series. The hot end of a succeeding tube would be located below the cold end of a preceding tube. Gas is then displaced through downstream regenerators for additional cooling, as reported in the Radebaugh article.

Figures 2, 2A, 2B:
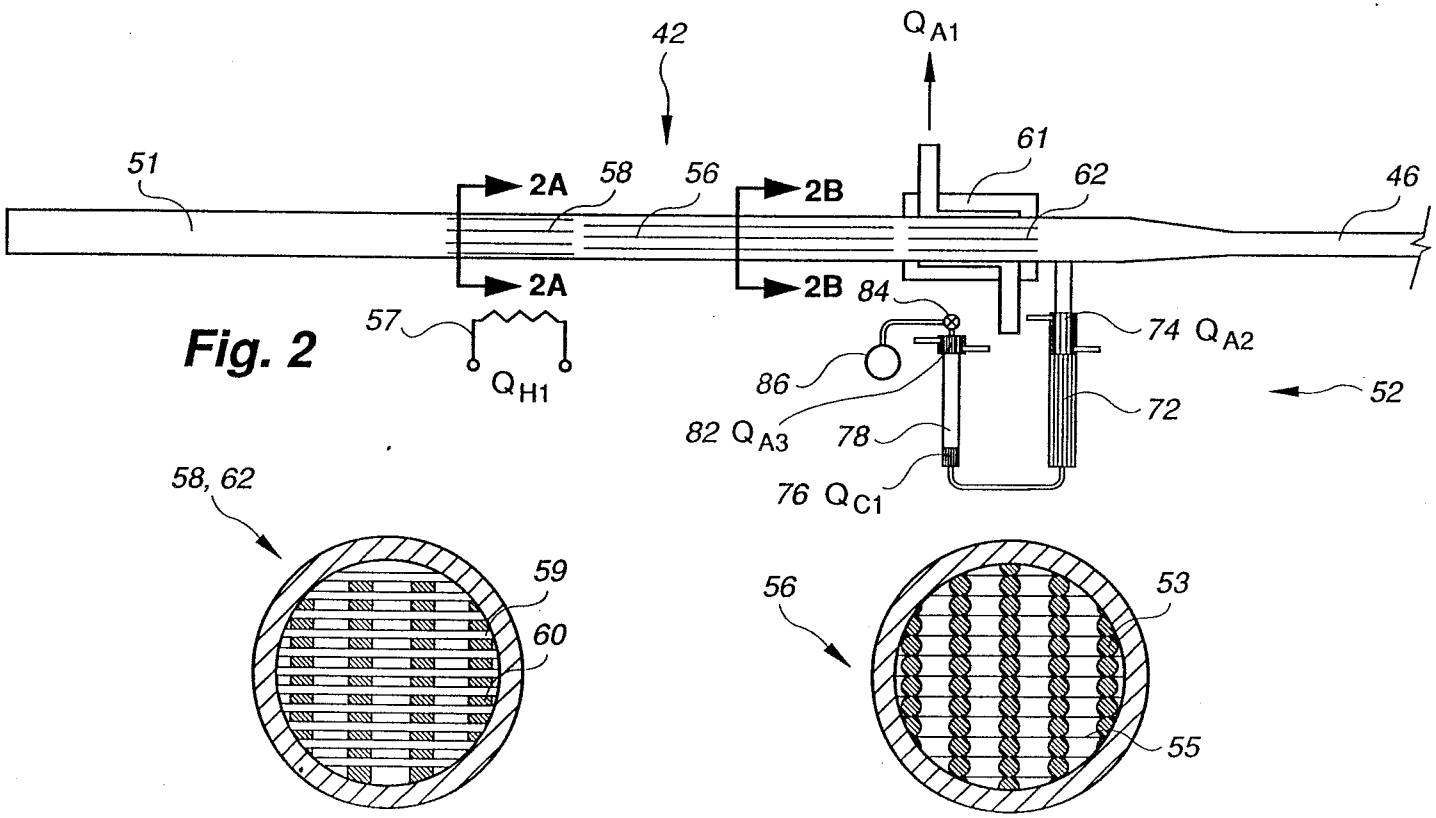
FIG. 2 is a pictorial illustration, in partial cutaway, of another embodiment of a cryocooler according to the present invention.

Another embodiment of the present invention is shown in partial cut-away by FIGS. 2, 2A, and 2B. TAD 42 is located at one end of standing wave tube 46 and located adjacent one antinode of the standing wave supported by tube 46. PTR 52 is now located adjacent the same standing wave antinode as TAD 42 and may be located on either the tube 46 side or the displacement volume 51 side of TAD 42 elements 56, 58, 62, although it is preferably located on the side of ambient Hx 62. PTR 52 remains in a high amplitude pressure wave region of the standing wave generated by TAD 42 to cool an external load as described in FIG. 1.

In a particular design configuration of the embodiment shown in FIG. 2, an operating frequency of 27 Hz, a working fluid of He gas at a mean pressure of 30 atm. (3 MPa), and a TAD 42 diameter of 5.2 cm were selected. Stack 56 comprises 0.013 cm thick stainless steel plates 55 which are spaced apart by 0.10 cm stainless steel bars 53, as shown in FIG. 2B. Plates 55 are preferably aligned along the axis of TAD 42 and stack 56 is 83 cm long. Stack 56 is centered about 1.24 m from the closed end of displacement volume 51.

Hx 58 and Hx 62, located at each end of stack 56, are shown in FIG. 2A. A stack of 0.05 cm thick Cu sheets 59 are spaced apart by 0.10 cm spacers 60. Spacers 60 are preferably formed of Cu for hot Hx 58 and of Pb-Sn solder for ambient Hx 62. Hot Hx 58 is 20 cm long to input about 1300W of heat at 1000K from external heaters 57. Hx 62 is 24 cm long and about 900W of heat is removed by cooling jacket 61 with water circulating at ambient temperature. With the above thermal flow, it is calculated that TAD 42 will produce about 400W of acoustic power with an oscillatory pressure amplitude of about 2.5 atm. (0.25 MPa). Plates 55 and plates 59 are preferably angularly rotated from one another to prevent flow blockage within their respective elements.

Standing wave tube 46 has a reduced diameter, as discussed above, to reduce viscous and acoustic losses within tube 46. A tube having the diameter of TAD 42 would be 19 m long. However, at a diameter of 3.2 cm a tube 46 length of only 9.3 m is required to support a 27 Hz resonance. The losses in tube 46 are calculated to be about 250W, leaving 150W to drive PTR 52. It will now be appreciated that a second TAD identical to TAD 42 may be provided at the other end of tube 46. The second TAD would also generate about 400W of acoustic power without increasing the losses in tube 46 so that 550W is now available to drive PTR 52.

Figure 3:
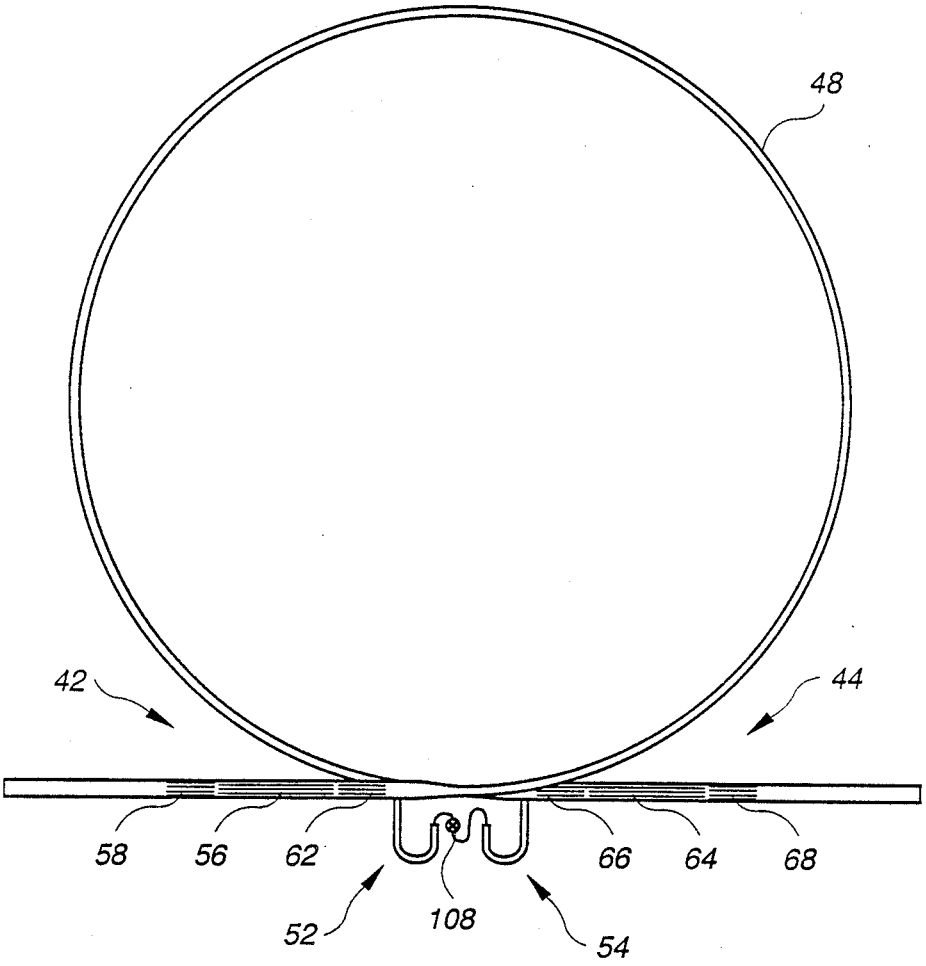
FIG. 3 is a pictorial illustration of a pair of cryocoolers depicted in FIG. 2 with the pulse tube refrigerators joined by an orificed line.

As described in FIG. 3, a second PTR 54 may also be provided adjacent second TAD 44 wherein each PTR receives about 275W for cooling. As shown in FIGS. 2 and 3, PTR's 52 and 54 may be individually or connectedly orificed, i.e., become OPTR's, for better cooling performance. Individual orifices 84 and reservoir volumes 86 enable individual cooling loads $Q_{c1}$ to be controlled for either OPTR 52 or 54. The design of OPTR's 52 and 54 is substantially as described for PTR 12 shown in FIG. 1.

Referring now to FIG. 3, there is shown a pictorial illustration, in partial cutaway, of another embodiment of the present invention. TAD 44 and TAD 42 are located at opposite ends of a resonant tube 48, whereby the input acoustic power can be substantially doubled without increasing the operating losses in standing wave tube 48. As shown in FIG. 3, standing wave tube 48 may be coiled to reduce the overall size of the cryocooler. A single coil diameter of 10 ft. supports the necessary standing wavelength for the above exemplary design while reducing the overall length of the cryocooler. Multiple coils may be possible to further reduce the overall size.

Thus, as depicted in FIG. 3, TAD 42 and TAD 44 are spaced apart about ½ wavelength by standing wave tube 48 such that both TAD 42 and 44 are adjacent an antinode of the standing wave supported by tube 48. Thermodynamic element stacks 56 and 64 are driven by heat exchangers 58, 62 and 66, 68, respectively, to generate the standing acoustic wave within tube 48.

PTR 52 and PTR 54 are connected to tube 48 adjacent antinode regions of the standing wave. The pressure wave amplitude variations then drive PTR 52 and PTR 54 through pressure amplitudes which are 180° out of phase. PTRs 52 and 54 each include a regenerator and pulse tube, as described for FIG. 2, with associated cooling loads, with heat removal through associated heat exchangers.

PTR 52 and PTR 54 may be connected through a single orifice 108. This configuration is particularly useful when only a single cooling control is needed. Since PTR 52 and PTR 54 operate 180° out of phase, orifice 108 can simply regulate fluid flow in and out of PTRs 52 and 54 at a phase effective to obtain the required heat removal. However, as noted for FIG. 2, if individual cooling loads are provided, PTRs 52 and 54 may be supplied with individual orifices and reservoir volumes for independent control.

The foregoing description of the preferred embodiments of the invention have been presented for purposes of illustration and description. It is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A thermoacoustic cryocooler having no moving parts, comprising:

a pulse tube refrigerator including a pulse tube, a first heat exchanger adjacent said pulse tube for inputting heat from a thermal load, and second heat exchanger for removing heat transferred from said first heat exchanger across said pulse tube;

said pulse tube being responsive to a fluid driving frequency for moving heat from said first heat exchanger to a higher temperature at said second heat exchanger;

a thermoacoustic prime mover for generating a standing acoustic wave at said fluid driving frequency and at a pressure amplitude effective to drive said pulse tube for obtaining a selected temperature at said first heat exchanger; and a standing wave tube supporting said standing wave and defining an antinode adjacent said pulse tube refrigerator.

2. A cryocooler according to claim 1, wherein said pulse tube refrigerator includes a regenerator having surface elements axially aligned within said pulse tube refrigerator and having a heat capacity greater than a heat capacity of said fluid and a thermal conductivity providing a high resistance to axial heat conduction.

3. A cryocooler according to claim 2, wherein said pulse tube refrigerator further includes an orificed reservoir for providing a fluid flow in phase with said standing wave.

4. A cryocooler according to claims 1, 2, and 3, wherein said pulse tube refrigerator is located adjacent said antinode of said standing wave that is spaced ½ wavelength from said prime mover.

5. A cryocooler according to claim 4, wherein said standing wave tube is coiled.

6. A cryocooler according to claim 5, wherein said standing wave tube has a diameter effective to minimize viscous and acoustic losses in said tube.

7. A cryocooler according to claim 4, wherein said standing wave tube has a diameter effective to minimize viscous and acoustic losses in said tube.

8. A cryocooler according to claims 1, 2, or 3, wherein said pulse tube refrigerator is located adjacent said antinode of said standing wave that is adjacent said prime mover.

9. A cryocooler according to claim 8, wherein said standing wave tube is coiled.

10. A cryocooler according to claim 9, wherein said standing wave tube has a diameter effective to minimize viscous and acoustic losses in said tube.

11. A cryocooler according to claim 8, wherein said standing wave tube has a diameter effective to minimize viscous and acoustic losses in said tube.

12. A cryocooler according to any of claims 1-3, wherein said frequency is in the range of 15-60 Hz and said pressure amplitude is in the range of 0.1-0.5 MPa.

13. A thermoacoustic cryocooler having no moving parts, comprising:

at least one pulse tube refrigerator including a pulse tube, a first heat exchanger adjacent said pulse tube for inputting heat from a thermal load, and a second heat exchanger for removing heat transferred from said first heat exchanger across said pulse tube;

said pulse tube being responsive to a fluid driving frequency for moving heat from said first heat exchanger to a higher temperature at said second heat exchanger;

two thermoacoustic prime movers for generating standing acoustic waves at said fluid driving frequency and at a pressure amplitude effective to drive said pulse tube for obtaining a selected temperature at said first heat exchanger; and a standing wave tube supporting said standing wave and defining antinodes adjacent said two prime movers and said at least one pulse tube refrigerator.

14. A cryocooler according to claim 13, wherein said at least one pulse tube refrigerator includes two pulse tube refrigerators, each of said pulse tube refrigerators being located adjacent a corresponding one of said prime movers and within an antinode of said standing wave.

15. A cryocooler according to claim 14, wherein each said pulse tube refrigerator further includes an orificed reservoir spaced from said regenerator for providing a fluid flow in phase with said standing wave.

16. A cryocooler according to claim 14, wherein said pulse tube refrigerators are connected together through an orifice for controlling fluid flow through said pulse tubes.

17. A cryocooler according to claim 13, wherein said two thermoacoustic prime movers are connected by a standing wave tube having a diameter effective to minimize viscous and acoustic losses in said tube.

18. A cryocooler according to any of claims 13-16 wherein said standing wave tube is coiled.

* * * * *